US006467900B1

(12) United States Patent
Askren et al.

(10) Patent No.: US 6,467,900 B1
(45) Date of Patent: Oct. 22, 2002

(54) PRINTZONE MEDIA SENSOR FOR INKJET PRINTER

(75) Inventors: Benjamin Alan Askren, Lexington; Ronald Willard Baker, Versailles; Stanley Dyer, Georgetown; Larry Steven Foster; John Anthony Schmidt, both of Lexington, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/503,434

(22) Filed: Feb. 14, 2000

(51) Int. Cl.[7] ..... B41J 2/03; G03G 15/04
(52) U.S. Cl. ..... 347/104; 399/388
(58) Field of Search ..... 347/103, 104; 400/708; 271/265.1; 399/16, 388, 393, 394

(56) References Cited

U.S. PATENT DOCUMENTS

| | | | | | |
|---|---|---|---|---|---|
| 2,818,252 | A | * | 12/1957 | Nilsson | 271/57 |
| 2,947,917 | A | * | 8/1960 | O'Brien | 317/149 |
| 4,641,949 | A | * | 2/1987 | Wallace et al. | 355/3 SH |
| 4,934,845 | A | | 6/1990 | Kato | 400/587 |
| 5,031,896 | A | * | 7/1991 | Winkler | 271/258 |
| 5,071,273 | A | | 12/1991 | Kato | 400/582 |
| 5,139,339 | A | | 8/1992 | Courtney et al. | 356/446 |
| 5,222,820 | A | | 6/1993 | Kamei et al. | 400/645 |
| 5,397,192 | A | | 3/1995 | Khormaee | 400/708 |
| 5,466,079 | A | | 11/1995 | Quintana | 400/579 |
| 5,564,848 | A | | 10/1996 | Quintana | 400/708 |
| 5,618,120 | A | | 4/1997 | Ishikawa | 400/708 |
| 5,619,240 | A | | 4/1997 | Pong et al. | 347/103 |
| 5,639,171 | A | | 6/1997 | Brewster, Jr. et al. | 400/708 |
| 5,826,156 | A | | 10/1998 | Natsume et al. | 399/389 |
| 5,870,114 | A | | 2/1999 | Numata et al. | 347/16 |
| 5,895,158 | A | | 4/1999 | Koyabu et al. | 400/605 |
| 5,897,259 | A | * | 4/1999 | Ahu | 400/629 |

* cited by examiner

*Primary Examiner*—Raquel Yvette Gordon
*Assistant Examiner*—Alfred E. Dudding
(74) *Attorney, Agent, or Firm*—Taylor & Aust P.C.

(57) ABSTRACT

An inkjet printer having a printhead closely adjacent a platen and a printzone therebetween has first and second juxtaposed counter-rotating feed rolls for transferring recording media from a first location where a media leading edge is located in an entrance nip between the first and second rolls and a second location where a media trailing edge is located in an exit nip between the first and second rolls. Printer control avoids printing to a media free printzone by sensing for the presence of a sheet of recording media within a nip between the primary and secondary feed rolls and selectively enabling and disabling the printer in accordance with the sensed media presence. The transverse dimension of a sheet of recording media may be estimated by multiple sensors and printer carriage travel limited to less than the estimated dimension.

17 Claims, 5 Drawing Sheets

PRINTZONE MEDIA SENSOR FOR INKJET PRINTER

BACKGROUND OF THE INVENTION

1. Field of the Invention

The present invention relates to recording devices such as printers and more particularly to an arrangement for determining the location and character of a recording medium within such a recording device.

2. Description of the Related Art

It is known to employ a media detection sensor to determine if a sheet of recording media has been successfully picked from an automatic sheet feed, if media has been loaded into a manual sheet feed, and to provide an indication when the end of a media sheet is approaching primary media feed rolls. It is also known to employ a reflective or other type optical sensor to detect whether print medium is on a platen. Such optical sensing systems are relatively expensive, complex and subject to failure or false indications.

SUMMARY OF THE INVENTION

The present invention provides a technique for confirming proper positioning of a recording medium such as a sheet of paper within a printer printzone.

The invention comprises, in one form thereof, an inkjet printer having a printzone closely adjacent a printhead and a pair of electrical contacts which open in response to a sheet of recording media entering the printzone and close in response to the sheet of recording media departing the printzone.

An advantage of the present invention is that printing directly onto the platen or other printer components is avoided.

Another advantage of the present invention is the presence of media in a printzone may be inexpensively and reliably detected and this presence signaled to an electronic controller, thereby eliminating certain printer failure modes.

A further advantage is that a recording medium characteristic, such as the transverse dimension, may be automatically estimated and the estimate utilized to control the extent of carriage travel.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

Figure 1:
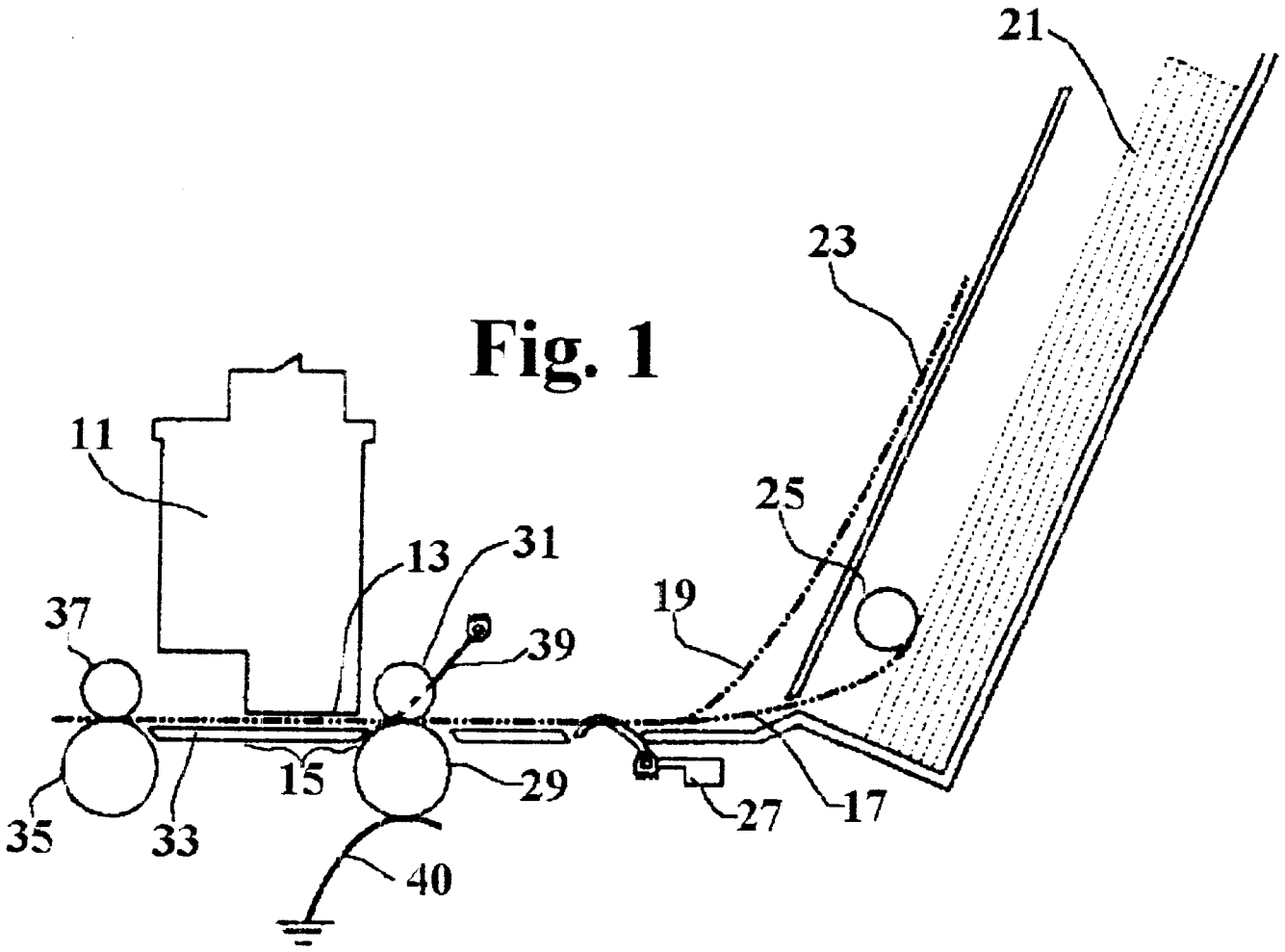
FIG. 1 is a side cross-sectional view of a portion of an inkjet printer showing a printhead and paper feed paths.

DETAILED DESCRIPTION OF THE INVENTION,

Referring now to the drawings and particularly to FIG. 1, there is shown an inkjet printer cartridge 11 having, near the bottom edge thereof, a printhead 13 spanning a printzone 15. The dotted lines 17 and 19 indicate recording media feed paths from an automatic feed tray 21 and a manual feed tray 23, respectively. The recording medium, a sheet of paper for example, is urged from the automatic feed tray 21 by feed roll 25 and along path 17 past media detect sensor 27. The sheet of paper passes between primary and secondary feed rolls 29 and 31, along platen 33 through the printzone 15 and from the platen between the exit rolls 35 and 37. A media detection sensor 27 determines if media has been successfully picked from the automatic sheet feed 21 as well as sensing if media has been loaded into the manual sheet feed 23. This media detection sensor 27 also provides an indication when the trailing edge or "end of form" of the medium is approaching the feed rolls 29 and 31.

Primary feed roll 29 has a conductive surface and is grounded by the wiper contact 40. A low friction, high wear electrical printzone contact 39 is spring loaded against the conductive surface of the primary feed roll 29. The point of contact of the printzone contact on the primary feed roll is slightly "down stream" of the nip of the feed rolls 29 and 31. An electronic controller (FIG. 5) is connected electrically to the printzone contact 39 and has circuitry to detect if the circuit between printzone contact, the primary feed roll, and the ground contact 40 is open or closed.

Figure 2:
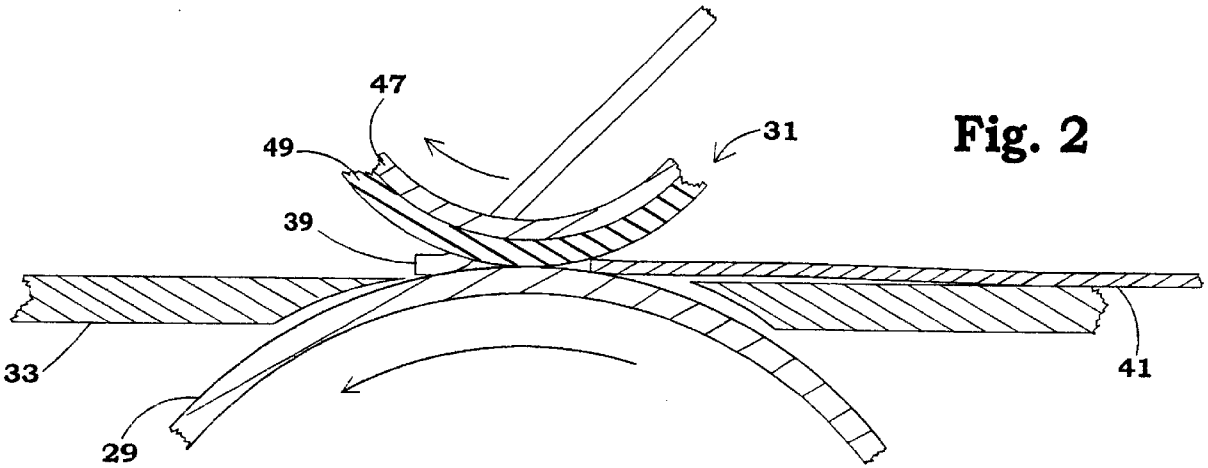
FIG. 2 is an enlarged cross-sectional view of a portion of FIG. 1 showing a recording media sheet entering the nip between the primary and secondary feed rolls.
Figure 3:
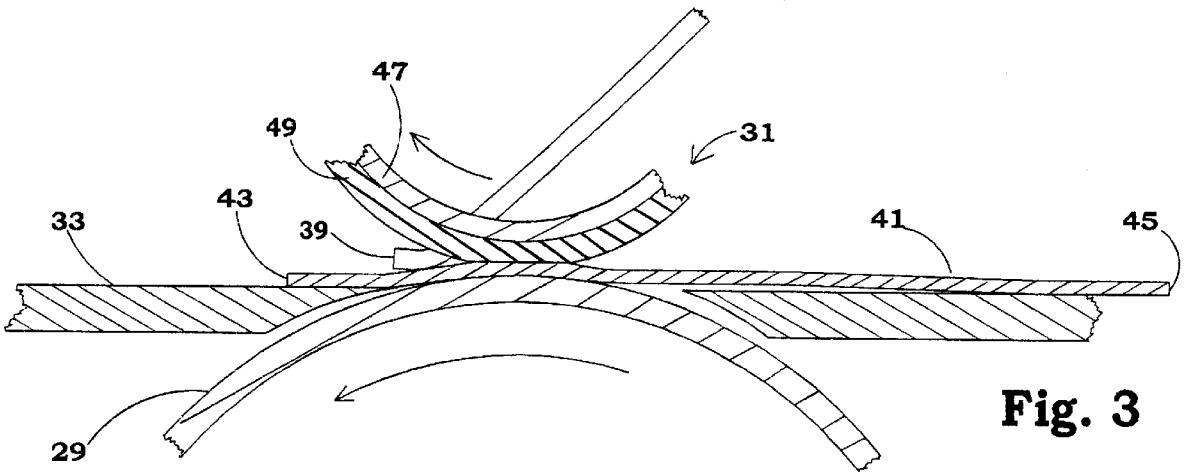
FIG. 3 is an enlarged cross-sectional view similar to FIG. 2, but showing the recording media sheet entering the printzone.

In FIG. 2, it will be noted that the entrance nip extends from where the rolls begin to grip the sheet to the general line of tangency between the cylindrical rolls while the exit nip extends from that line of tangency to where the rolls cease gripping the sheet. The region between where the sheet is first gripped and where it is released is referred to generally as the nip between the rolls. A sheet 41 of recording media is fed manually, or by feed roll 25 to the position illustrated in FIG. 2 where it is gripped and advanced by the counter-rotating rolls 29 and 31. As the leading edge 43 of sheet 41 begins to exit the nip, it passes between the roller 29 surface and the sliding contact 39 raising the contact from the roller surface and interrupting the circuit from the contact 39 to ground as illustrated in FIG. 3. This circuit is re-established by the passage of media trailing edge 45 from between the nip. Feed roll 29 has an electrically conductive surface to interconnect the two sliding contacts 39 and 40 and is shown as a metallic tube. Secondary feed roll 31 may have a rubber or other paper gripping surface 49 coating a metallic tube 47. The role of the rolls may be interchanged so that the contacts slidingly engage a conductive surface of the secondary roll 31. Similarly, a narrow conductive annular strip intermediate higher friction roll surfaces may be desirable. Other feed roll surface combinations may be used so long as a conductive surface selectively connects the two contacts and the recording media is adequately gripped and fed into the printzone.

Figure 4:
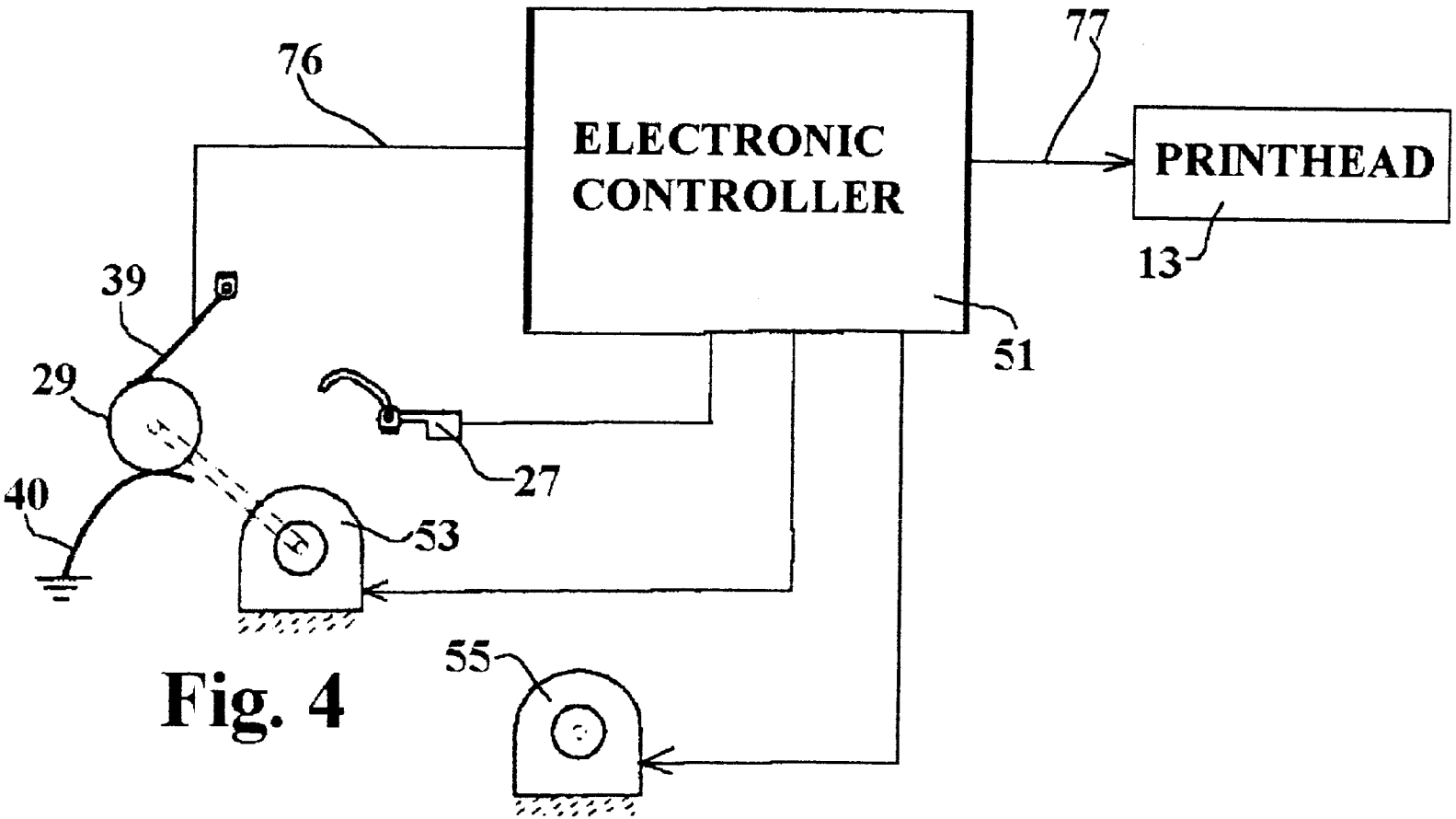
FIG. 4 is an electrical schematic diagram of the controller and circuitry of FIG. 1.

In FIG. 4, the electronic controller 51 receives input from the media detector sensor 27 and supplies enabling signals to primary feed roll drive motor 53, automatic sheet feed drive motor 55 and printhead 13. Controller 51 is also responsive to the grounded or ungrounded status of slider contact 39 to appropriately control motors 53 and 55, and printhead 13. Electronic controller 51 is coupled to electrical contact 39, electrically conductive surface 29 and printhead 13 for inhibiting printhead 13 from disbursing ink so long as electrical contact 39 engages the electrically conductive surface.

Figure 5:
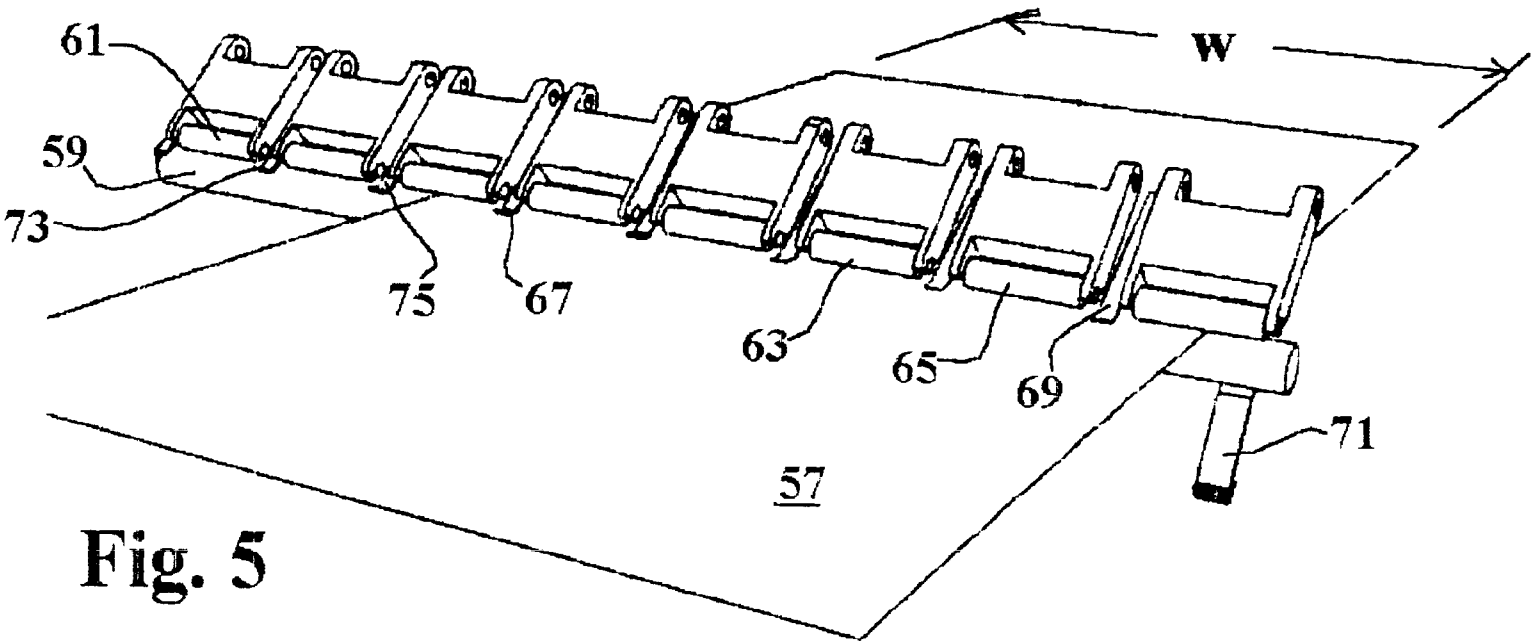
FIG. 5 is a partial perspective view of a recording medium and media feed rolls illustrating a variation on the present invention.

FIG. 5 illustrates an extension of the concept of FIGS. 1–3. A primary feed roll 59 has a conductive surface and slider contact 71 couples the conductive surface to ground. There are a plurality of secondary feed rolls such as 61, 63, and 65 rotatable about a common axis and interleaved with a plurality of slider contacts such as 67, 69 and 73. When a sheet of recording media 57 passes between the primary and secondary feed rolls, certain of the sliders are lifted from the conductive surface while others remain in contact with that surface. The number and locations of the grounded and un-grounded contacts gives an estimate of the width of sheet 57. For example, contacts 67 and 69 raise from the feed roll surface while contact 73 remains grounded. As illustrated, five of the eight contacts open as the sheet passes. As an illustrative example, if the width W of the sheet 57 is the common 8½ inches, contacts 67 and 69 as well as the intervening contacts would be un-grounded while passage of a larger sheet, such as an 11×17 inch sheet, might also un-ground contact 75. With such an extension, additional printzone detect contact inputs similar to 76 and a carriage control output similar to 77 would be added to FIG. 4 so that the lateral extent of carriage travel could be limited to the media width.

Figure 7:
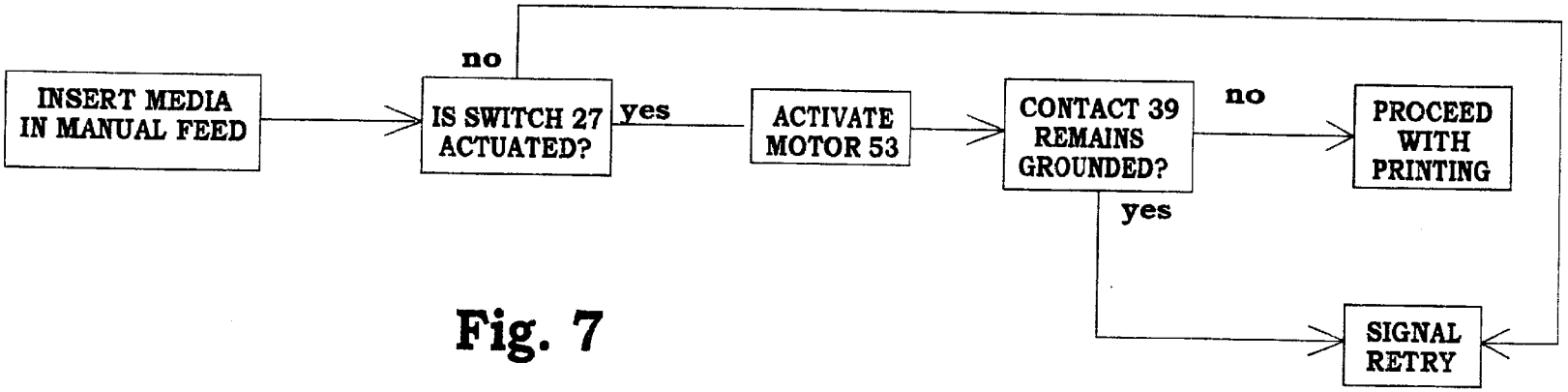
FIG. 6 is a schematic illustration of a process for automatic media feed and FIG. 7 is a schematic illustration of a process for manual media feed.

Comparing FIGS. 1, 4 and 7, a normal manual feed begins when media is inserted into the manual sheet feed 23 until stopped and aligned by the stationary primary feed rolls 29 and 31. The media detection sensor 27 detects the medial and signals the electronic controller 51. Knowing that it did not request a feed from the automatic sheet feed 21, the electronic controller interprets the signal from the media detection sensor to mean that the user is initiating a manual feed and enables motor 53 to activate the primary feed rolls 29 and 31 advancing the media into the printzone. If this advance was successful, contact 39 becomes ungrounded. The electronic controller 51 shuttles and fires the printhead 13 while advancing the media for the purpose of printing the document. When the electronic controller has completed printing the document, it starts to advance the media out of the printzone. The media detection sensor 27 detects the end of the media and signals the electronic controller which utilizes the signal to estimate how much more it can advance the media before the paper will no longer be in the primary feed rolls.

A failure in known systems can occur if the media is not inserted into the manual sheet feed sufficiently far to be stopped and aligned by the stationary primary feed rolls 29 and 31, but far enough that sensor 27 detects the media and signals the electronic controller which responds by activating the primary feed rolls in an attempt to advance the media into the printzone. Since the paper never reached the primary feed rolls, none is fed into the printzone, however, the electronic controller shuttles and fires the printhead while attempting to advance the media for the purpose of printing the document. Ink is deposited on printer components rather than the paper and may smear upon the next page fed through the printzone. When the electronic controller has completed printing the document, it attempts to advance the media out of the printzone and the media detection sensor 27 should detect the end of the media and signal the electronic controller. However, since the leading edge of the media is still between the media detection sensor and the primary feed rolls, the state of the media detection sensor never changes. After attempting to feed the media for a distance that is further than what would be necessary to eject the printer's largest specified media, the electronic controller concludes that there must be a paper feed problem and takes the printer off line. The printzone detect contact 39 solves this failure problem.

If the media advances into the printzone, it breaks the circuit between the printzone contact 39 and the primary feed roll 29. If the paper never reached the primary feed rolls, it is not in the printzone and thus the circuit remains closed. The electronic controller 51 does not perceive a change in state in the printzone contact. It thus concludes that the manual feed did not occur properly and signals the user to retry loading the media. Since the connection to ground is interrupted by the passage of a sheet of recording media, the invention is fail-safe in the sense that a dirty contact or similar failure results in a failure or retry signal rather than printing without paper in the printzone.

Figure 6:
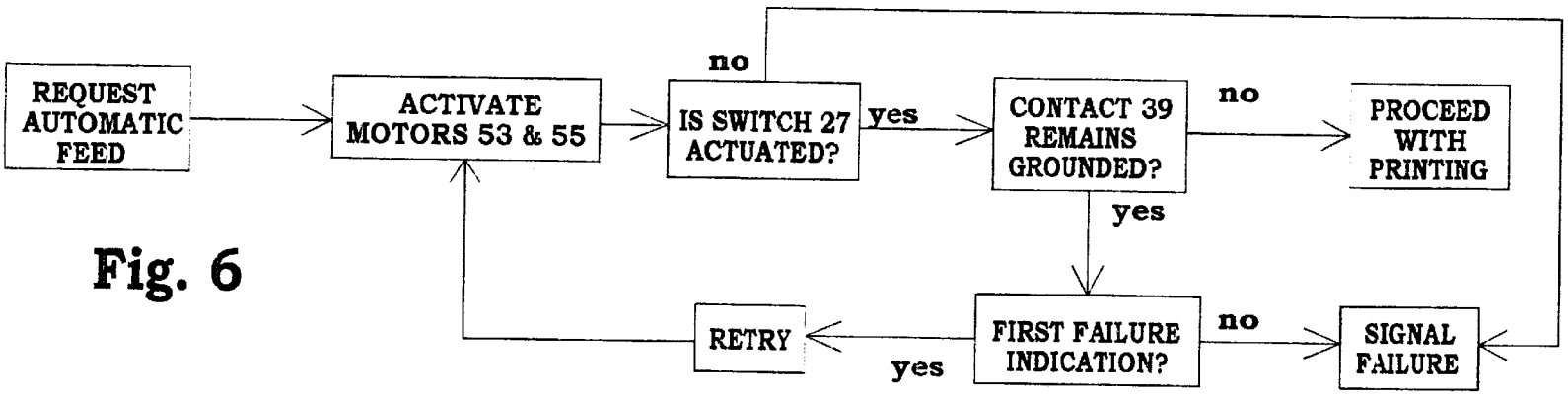

Similar media feed problems in the automatic mode are similarly obviated by the present invention as illustrated in FIG. 6. When an automatic sheet feed from 21 is initiated by the electronic controller, the controller first activates the automatic sheet feed drive motor 55 to advance media sheets from the feed tray and then activates the primary recording media feed roll drive motor 53. The controller utilizes the signal on line 76 for sensing for the presence of a sheet of recording media within the nip between the primary and secondary feed rolls and selectively enables or disables the printing device in accordance with the sensed media presence. If media is not sensed when it should be, a single retry attempt is made followed by disabling the printing device and providing a failure indication which signals the user that a paper jam has occurred.

The electronic controller can estimate the width of the media by monitoring the states of the array of printzone detect contacts shown in FIG. 5. Thus, if a document that is wider than the media present is to be printed, the electronic controller can "clip" or reduce the size of the document to be printed to prevent ink from being jetted beyond the media boundaries. This in turn would reduce the likelihood of ink on printer components. The monitoring can either utilize the state of each individual printzone contact or the printzone contacts may be connected in a parallel circuit and the resistance or current of that circuit monitored. If the media is fed from the automatic sheet feed, the electronic controller can utilize the estimate of the media width in conjunction with an estimate of the media length to determine the standard size of the media in the automatic sheet feed. Media length estimate can be calculated by data from the printzone contact and information on the position of the primary feed roll. Once the electronic controller has determined the standard size of the media, that information can be fed back to the appropriate driver software and application program.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An inkjet printer comprising:

at least one printhead;

a platen located adjacent the printhead;

a source of recording media;

a plurality of feed rolls for transferring recording media from the source to a printzone between the platen and the printhead including first and second juxtaposed counter-rotating feed rolls for conveying media from a first location where a media leading edge is located in an entrance nip between the first and second rolls and a second location where a media trailing edge is located in an exit nip between the first and second rolls;

an electrically conductive lateral surface area on the first feed roll; and at least one electrical contact for selectively slidingly engaging the electrically conductive surface, each said electrical contact positioned near the exit nip and biased toward the electrically conductive surface, the electrical contact thereby normally slidingly engaging the electrically conductive surface and responding to the passage of the media leading edge to disengage from the electrically conductive surface.

2. The inkjet printer of claim 1, further comprising:

a second electrical contact normally engaging the electrically conductive surface;

an electronic controller; and electrical circuitry coupling the one and second electrical contacts to the controller.

3. The inkjet printer of claim 1, wherein there is exactly one electrical contact selectively engaging the electrically conductive surface, and further comprising an electronic controller coupled to the electrical contact, the electrically conductive surface and the printhead for inhibiting the printhead from disbursing ink so long as the electrical contact engages the electrically conductive surface.

4. An inkjet printer comprising:

at least one printhead;

a platen located adjacent the printhead;

a source of recording media;

a plurality of feed rolls for transferring recording media from the source to a printzone between the platen and the printhead including first and second juxtaposed counter-rotating feed rolls for conveying media from a first location where a media leading edge is located in an entrance nip between the first and second rolls and a second location where a media trailing edge is located in an exit nip between the first and second rolls;

an electrically conductive lateral surface on the first feed roll; and a plurality of laterally spaced electrical contacts selectively engaging the electrically conductive surface, each said electrical contact positioned near the exit nip and normally engaging the electrically conductive surface and responding to the passage of the media leading edge to disengage from the electrically conductive surface, the number and location of the particular contacts which respond to the passage of the media leading edge indicating the width of the media.

5. The inkjet printer of claim 4, wherein the second feed roll comprises a plurality of spaced cylindrical rollers rotatable about a common axis and the plurality of electrical contacts are interleaved between the cylindrical rollers.

6. An inkjet printer having a printzone closely adjacent a printhead, at least a first feed roll positioned adjacent said, printzone and a pair of electrical contacts which are operatively associated with said first feed roll and which open in response to a sheet of recording media passing therebetween and entering the printzone and close in response to the sheet of recording media departing the printzone, one said electrical contact being a slide contact biased toward another-of-said pair of electrical contacts.

7. The inkjet printer of claim 6, wherein said first feed roll has an electrically conductive cylindrical surface area, said electrically conductive cylindrical surface area of said first feed roll comprising an other of said pair of contacts.

8. An inkjet printer having a printzone closely adjacent a printhead, at least a first feed roll positioned adjacent said printzone and a pair of electrical contacts which are operatively associated with said first feed roll and which open in response to a sheet of recording media passing therebetween and entering the printzone and close in response to the sheet of recording media departing the printzone, further comprising additional pairs of contacts laterally spaced from one another and from said pair of contacts, each pair opening when a recording media passes therebetween and closing when the recording media moves beyond that pair of contacts.

9. The inkjet printer of claim 8, wherein the number and location of contact pairs which open as media passes is indicative of the position and width of the particular media.

10. A process of controlling a printing device of the type having at least one printhead, a printhead supporting carriage, and juxtaposed primary and secondary recording media feed rolls for engaging opposed media surfaces and conveying the engaged media to a printzone closely adjacent the printhead, comprising the steps of:

sensing for the presence of a sheet of recording media within a nip between the primary and secondary feed rolls, the step of sensing including grounding an electronic controller input so long as no sheet is present within the nip and un-grounding the electronic controller input in response to the passage of a sheet through the nip; and selectively enabling and disabling the printing device in accordance with the sensed media presence.

11. The process of claim 10, including the additional step of estimating a length dimension of a sheet of recording media dependent on the sensed media presence.

12. The process of claim 10, wherein the media is fed from an automatic media feed tray to the printzone, the process further including the steps of:

activating an automatic sheet feed drive motor to advance media sheets from the feed tray prior to the step of sensing; and activating a recording media feed roll drive motor prior to the step of sensing.

13. A process of controlling a printing device of the type having at least one printhead, a printhead supporting carriage, and juxtaposed primary and secondary recording media feed rolls for engaging opposed media surfaces and conveying the engaged media to a printzone closely adjacent the printhead, comprising the steps of:

sensing for the presence of a sheet of recording media within a nip between the primary and secondary feed rolls;

selectively enabling and disabling the printing device in accordance with the sensed media presence;

estimating a transverse dimension of a sheet of recording media; and limiting carriage travel to less than the estimated dimension.

14. A process of controlling a printing device of the type having at least one printhead, a printhead supporting carriage, and juxtaposed primary and secondary recording media feed rolls for engaging opposed media surfaces and conveying the engaged media to a printzone closely adjacent the printhead, the media being fed from an automatic media feed tray to the printzone, comprising the steps of:

sensing for the presence of a sheet of recording media within a nip between the primary and secondary feed rolls.

selectively enabling and disabling the printing device in accordance with the sensed media presence, the step of selectively enabling and disabling including a single retry attempt followed by disabling the printing device and providing a failure indication;

activating an automatic sheet feed drive motor to advance media sheets from the feed tray prior to the step of sensing; and activating a recording media feed roll drive motor prior to the step of sensing.

15. A process of controlling a printing device of the type having at least one printhead, a printhead supporting carriage, and juxtaposed primary and secondary recording media feed rolls for engaging opposed media surfaces and conveying the engaged media to a printzone closely adjacent the printhead, the media being fed from a manual media feed tray to the printzone, the process comprising the steps of:

confirming the presence of a sheet of recording media in the feed tray;

activating the recording media feed roll drive motor to advance the sheet of recording media;

sensing for the presence of a sheet of recording media within a nip between the primary and secondary feed rolls, the step of activating occurring prior to the step of sensing; and selectively enabling and disabling the printing device in accordance with the sensed media presence.

16. The process of claim 15, wherein the step of selectively enabling and disabling includes:

disabling the printing device; and providing a retry indication if the step of sensing fails to indicate the presence of a sheet of recording media within the nip between the primary and secondary feed rolls.

17. An inkjet printer having a printzone closely adjacent a printhead, and a pair of electrical contacts which open in response to a sheet of recording media passing therebetween and entering the printzone and close in response to the sheet of recording media departing the printzone, one of said pair of contacts comprising a feed roll electrically conductive cylindrical surface area, an other of said pair of contacts being a slide electrical contact biased toward said feed roll electrically conductive cylindrical surface area.

* * * * *